US006840031B2

(12) United States Patent
Blackmore et al.

(10) Patent No.: US 6,840,031 B2
(45) Date of Patent: Jan. 11, 2005

(54) APPARATUS FOR AND METHOD OF MANUFACTURING COMPACTED CABLES BY USE OF RIGID CAGE STRANDERS

(75) Inventors: Andrew Blackmore, King (CA); Paul White, Newmarket (CA)

(73) Assignee: Roteq Machinery, Inc., Concord (CA)

( * ) Notice: Subject to any disclaimer, the term of this patent is extended or adjusted under 35 U.S.C. 154(b) by 36 days.

(21) Appl. No.: 10/117,594

(22) Filed: Apr. 5, 2002

(65) Prior Publication Data

US 2003/0188524 A1 Oct. 9, 2003

(51) Int. Cl.[7] ..... D01H 1/10
(52) U.S. Cl. ..... 57/58.52; 57/6
(58) Field of Search ..... 57/6, 9, 13, 58.3, 57/58.32, 58.34, 58.36, 58.38, 58.52, 64, 65, 66, 66.5, 67, 311

(56) References Cited

U.S. PATENT DOCUMENTS 4,212,151 A * 7/1980 Schauffelle et al. ..... 57/9
4,599,853 A * 7/1986 Varga-Papp ..... 57/9
4,641,492 A * 2/1987 Glushko et al. ..... 57/9
4,947,637 A * 8/1990 Royet et al. ..... 57/311
5,074,140 A * 12/1991 Sanders ..... 72/248
5,282,353 A * 2/1994 Kellstrom, Jr. ..... 57/13

* cited by examiner

*Primary Examiner*—John J. Calvert
*Assistant Examiner*—Shaun R Hurley
(74) *Attorney, Agent, or Firm*—Myron Greenspan, Esq.; Lackenbach Siegel, LLP

(57) ABSTRACT

In an apparatus for cable manufacture, a cage strander rotates about a line axis at a chosen rotational speed. Bobbins supported by the strander dispense round conductors downstream of the cage strander. A forming apparatus downstream of the strander receives the conductors and forms them into many complementary segmented preshaped wires each having the desired cross-sectional profile in a final compact conductor. The conductors are positioned in a way that substantially corresponds to the orientations among wires in the final conductor. A first drive rotates the forming apparatus about the line axis substantially at the rotational speed of the strander. A second drive drives the forming apparatus. The drives are synchronized so that the conductors close about the core and cause the sides of adjacent wires to abut against each other to produce both the desired lay and a cable substantially without interstices between the wires forming the twisted conductor.

15 Claims, 6 Drawing Sheets

APPARATUS FOR AND METHOD OF MANUFACTURING COMPACTED CABLES BY USE OF RIGID CAGE STRANDERS

BACKGROUND OF THE INVENTION

1. Field of the Invention

The invention generally relates to the high-speed manufacture of compact stranded cable and, in particular, to an apparatus for manufacturing compact cables by use of rigid stranders.

2. Description of the Prior Art

Machines for twisting wires for the formation of cables have been in existence for many years. While numerous different types of machines have been proposed, such machines will generally be classified into two basic types: "cage stranders" and "single/double twist stranders." One fundamental difference between these two types of machines is that with cage stranders, the product does not rotate relative to the ground. In other words, the material that is being applied rotates around an advancing core about a center line or line axis of the machine. In the single/double twist machines, the products rotate in the process, allowing the material that is being applied to be paid off from stationary pay-offs. For purposes of the discussions herein, "cage-type machines" or "cage stranders" shall mean, by way of example: bow; skip; rigid; planetary; and tubular machines or stranders. Examples of single/double twist machines include, by way of example: single twist; universal; drum; and double twist machines or stranders.

For the most part round wires are used as an input to the stranding process. These round wires are formed into multiple layers to produce the stranded cross section. Reducing the cross sectional area and changing the shape of the stranded conductor has advantages in the manufacture of insulated conductors; bare transmission cables as well as hybrid cables similar to Optical Ground Wires (OPGW) and the like.

The criteria that drive the technology for electrical conductors is to maximize the current carrying capacity of the conductors with a specified cross section of the final or stranded cable or to reduce the cross section for a specified current carrying capacity. As a consequence techniques have been developed to reduce the empty spaces in stranded conductor by pulling the single wires or the conventionally stranded conductor through dies or roll sets. By doing this each round wire is compressed against each other and the same conductivity of a conductor can be achieved with a smaller overall cross section. This applies equally to round; sectored and milliken conductors.

Transmission cables consist of bare conductors used for overhead transmission of electrical energy. An essential criterion is the reduction in cross section of the strand or the strand design to reduce the wind resistance or weight of the strand while maximizing the current carrying capacity.

Optical Ground Wires are dual purpose transmission cables that have a fiber optic bundled as part of the construction. The fiber bundle provides communication links for conventional data transmission as well as provides a grounding circuit for power transmission lines.

Changing the conductor compactness or density of the conductor shape is performed traditionally in three ways:

(1) By changing the wire diameter of some of the elements in the strand to better fill the interstices of the stranded conductor. An example of this technique is disclosed in U.S. Pat. No. 4,471,161.

(2) By compacting one or more layers through a die or series of dies, set of rollers or sets of rollers. An example of this technique is described in U.S. Pat. No. 3,444,684.

(3) By changing the section of the wire prior to closing a layer of strand to facilitate the forming of that layer to achieve the desired objective. This process is typically done in one of three ways:

(a) By rolling the section in the wire drawing process. This is typically done in one or two positions between the final two or three capstans of the wire drawing machine. See, for example, U.S. Pat. No. 4,843,696.

(b) By rolling each individual wire on the strander immediately prior to the closing die, as disclosed, for example, in U.S. Pat. Nos. 42,212,151 and 5,074,140.

(c) U.S. Pat. No. 4,599,853 describes a process that rolls or shapes the input wire in line with the single twist and double twist machines. This stationary driven rolling system rolls the wires into the desired shape in line with the process equipment. It is a stationary device that operates outside the rotating body of the machine.

All of the abovementioned traditional processes with the exception of 3(c) use the strength of the rolled section to pull the wire through the profiling rolls. When using a lubricant that is typically the residue of the wire drawing process on the wire the area reduction that can be achieved with the non-driven roll forming process is between 10% and 14%. The area reduction that can be achieved with the driven roll form process can be close to 30%. The significance of area reduction relates to the degree of shaping that occurs in the wire. The greater the area reduction for the same input material the greater the definition in the final profile and as a consequence the potential for a higher degree of compaction in the finished strand.

Each of the strander machine types may a particular advantage for a given application. The single/double twist machines tend to have the capability to rotate at higher speeds, and therefore the capacity for higher output. However, because the single and double twist machines involve twisting the product, it is not practical to use them for conductors that are made of harder alloys less easy to twist or for larger-diameter conductors with less flexibility. Thus, while the aforementioned U.S. Pat. No. 4,599,853 discloses driven rollers for forming circular or round diameter conductors, such forming apparatus is used in conjunction with a double twist machine and, therefore, may not be suitable to certain applications for the reasons aforementioned. On the other hand, cage-type machines or stranders, which have been more appropriately used with less flexible products, have not employed driven forming devices. Examples are illustrated in aforementioned U.S. Pat. No. 4,212,151, in which a rigid strander is used in conjunction with a forming apparatus that includes pairs of cooperating forming rollers between which round conductors pass during the forming of the conductors. However, the rollers that form the round conductors are not driven and, therefore, there are limitations to the amount of area reduction that can be achieved. The same is true for the high-speed cable shaping and stranding machine disclosed in the aforementioned U.S. Pat. No. 5,074,140, in which a forming device consisting of a plurality of roller pairs for shaping cross sections of wires is mounted for rotation with a tubular strander. Again, the forming rollers are not driven and, therefore, display the same disadvantages previously mentioned.

SUMMARY OF THE INVENTION

The object of this invention is to introduce the driven input wire roll form capability to cage type machines (primarily tubular planetary concentric and rigid stranding machines) to provide a machine for manufacturing conductors with a high degree of compactness to address requirements that covered within the capabilities of the single twist and Double Twist machines with the added benefit of those products that are outside the practical capabilities of the Single Twist and Double Twist processes.

The present invention comprehends modification of the stranding apparatus and stranding method to form the preshaped wire as the wire is advanced through the strander. A plurality of wire guide and shaping assemblies, each including a pair of forming and shaping rollers or wheels and each wheel being mounted on parallel axles in a frame, form the wire. The spacing between the axles may be adjusted without varying the parallel alignment of the axles or the wheel alignment.

It is an object of the present invention is to provide a method and apparatus to form and shape round drawn wire to a desired cross section in conjunction with use of cage stranders.

Another object of the present invention is to provide a method of both forming the preshaped wire and of stranding the preshaped wire into the compact cable in a single operation.

Still another object of the invention is the provision of apparatus for simultaneously forming and shaping a plurality of round drawn wires into a compact cable with a desired cross section, in which each wire is formed and shaped at a substantially greater speed than typical of the drawing process, and thereby substantially improving the production speed of the compact cable.

It is yet another object of the present invention to provide a combination of a plurality of easily adjusted forming and shaping assemblies with a rigid frame strander to permit both shaping of a drawn wire and stranding of the shaped wire into a compact cable in a single apparatus.

A further object of the present invention is the provision of a forming device that can be used as a "stand-alone" or "portable" unit or can be mounted on or otherwise secured to a rigid strander.

A still further object of the present invention is to provide an apparatus of the type suggested in the previous objects that is simple in construction and easy to use.

Yet another feature of the present invention is a substantial increase in production rate of compact stranded cable, made possible by combining the shaping and stranding steps of multiple wires in a single operation at high stranding speeds with use of rigid stranders.

Still another feature of the present invention is the provision of an apparatus for forming each of the different shapes required for the various compact cable individual wire components.

Another feature of the present invention is the provision of apparatus for forming and shaping the plurality of strander input wires into shaped compact cable wires during the stranding operation.

An advantage of the present invention is that the forming and shaping wheel axles are easily set into parallel alignment and remain so even when adjustment of the spacing between the axes is necessary.

Yet another advantage of the invention is that the forming apparatus can be used with one or more pairs of forming rollers.

Another advantage of the present invention is that by forming and shaping the wires immediately prior to stranding, wire surface defects are reduced which results in fewer interstitial defects within the compact stranded cable.

In accordance with these and other features and advantages of the present invention hereinafter disclosed, there is provided a method of and an apparatus for the combination of high speed forming and shaping of drawn wire and the stranding of the same in a single operation and apparatus.

The method of accomplishing the foregoing includes the steps of providing a layhead with a plurality of wire guide and shaping assemblies mounted thereon, adjusting the spacing of each of the respective axes of the forming wheel pairs used to form and shape the wire cross sections, for all of the wire guide and shaping assemblies used to form the cable. The cable is then formed by advancing a plurality of wires through the strander; guiding the plurality of wires through the layhead in the strander; forming each of the plurality of wires into a predetermined non-circular shape at or near the layhead plane, each of the wires being formed in a plurality of individual high speed wire guide and shaping assemblies for changing the cross section of the wire, each wire guide and shaping assembly including a first profiled wire shaping wheel rotatable about a first axis and a second wire shaping wheel rotatable about a second axis wherein the second axis is substantially parallel to the first axis and the wheels are aligned with respect to one another; stranding the shaped wires into cable; and collecting the stranded cable.

An additional step of subjecting the stranded cable to a further compacting step or cross section altering step may be performed. Other processing may include a step wherein the wire shaping wheels cooperate to form a desired wire passage having a predetermined cross section, such as a trapezoidal cross section, a sector cross section including at least one curvilinear surface, and/or a sector cross section including at least one flat surface, in order to provide the specific profiles necessary to form the desired cable cross section.

The apparatus for accomplishing the foregoing features and advantages comprises an apparatus for forming and shaping a plurality of wires into a stranded cable; a device for advancing a plurality of wires into the forming device; a layhead for guiding the plurality of wires into the forming device; and a plurality of wire guide and shaping assemblies mounted thereon for shaping the plurality of wires. Each of the wire guide and shaping assemblies includes a frame, a first wire shaping wheel rotatable about a first axis and a second wire shaping wheel rotatable about a second axis, the second axis being substantially parallel to and adjustably displaced from the first axis.

Additional features and apparatus may include those wherein the wire shaping wheels cooperate to form a wire passage of a desired, predetermined cross section such as a trapezoidal cross section, a sector cross section including at least one curvilinear surface, and/or a sector cross section including at least one flat surface, in order to provide the conductor cross sections necessary to form the desired cable cross section. In another feature of the apparatus, at least one of the wire shaping wheels further includes opposing flanges which substantially enclose the wire for restricting the wire passage to the desired predetermined cross section.

In order to achieve the above objects, as well as others that will become apparent hereafter, an apparatus for the manufacture of compact cables formed by at least one uniform lay of conductors received about and compacted on a core comprises a cage strander arranged for rotation about a line axis at a selected rotational speed. A plurality of bobbins are provided, at least equal in number to the number of conductors in said lay, each supporting a length of round conductor. Each of said bobbins is supported by said cage strander and arranged for dispensing a round conductor downstream of said strander. A forming apparatus is provided arranged downstream of said cage strander for receiving said conductors and forming them into a plurality of complementary segmented pre-shaped wires, each having a desired cross-sectional profiled configuration in a final compact conductor and each defining at least lateral surfaces. Means are provided for positioning and orienting the pre-shaped wires with relation to each other to substantially correspond to the positions and orientations therebetween in the final twisted compact conductor. A first driving means rotates said forming apparatus about said line axis, substantially at the speed of the rotation of said cage strander. A second drive means drives said forming apparatus, said first and second driving means being synchronized to allow said formed conductors to be closed about said core to cause the lateral surfaces of adjacent pre-shaped wires to substantially abut against each other and to produce the desired lay. In this way, interstices between the wires forming the twisted conductor are substantially eliminated to form a compact twisted conductor.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF PREFERRED EMBODIMENTS

Figure 1:
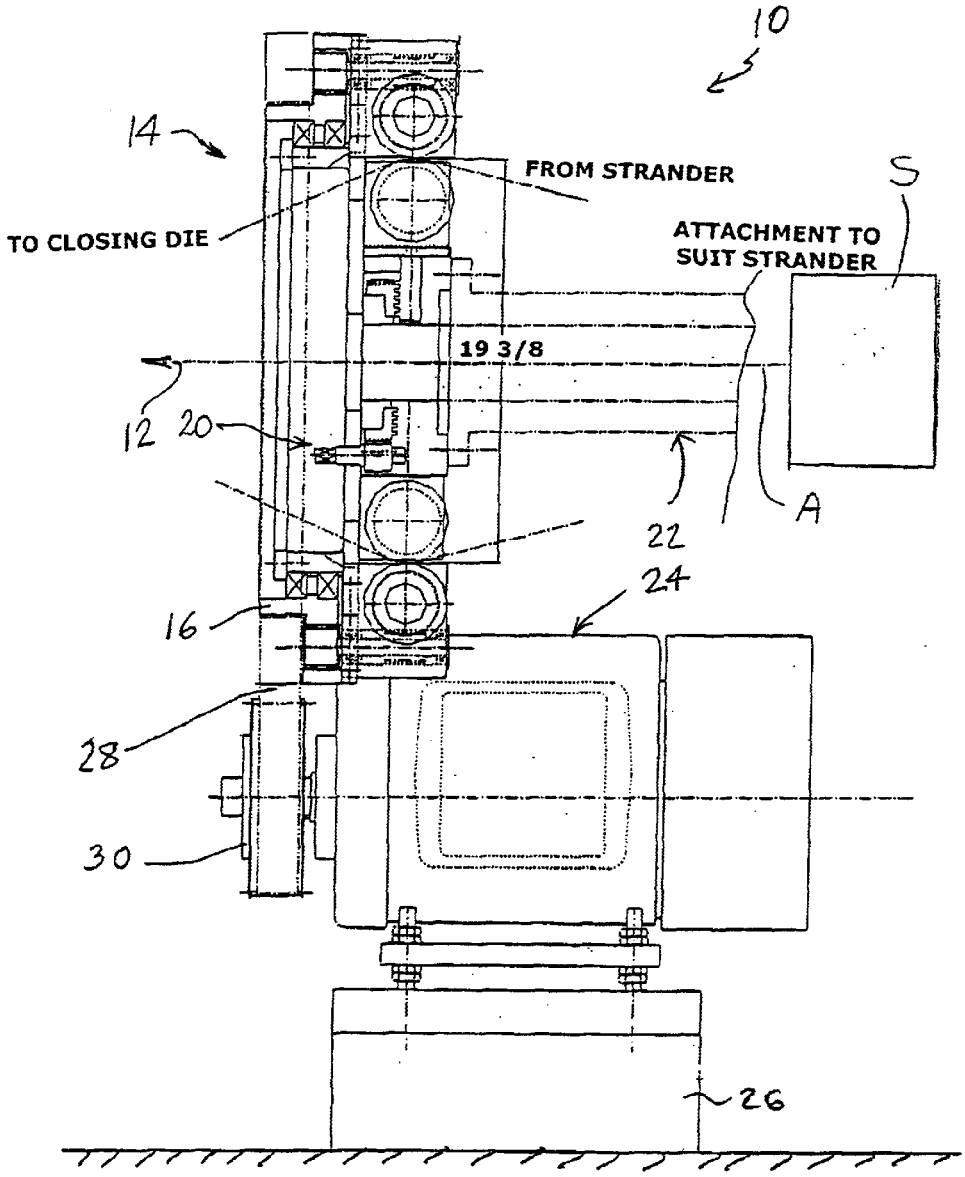
FIG. 1 is a side elevational view of one embodiment of an apparatus in accordance with the present invention, showing a forming apparatus that can be suitably coupled to a rigid strander for forming circular or round cross-sectional conductors emanating from the rigid strander prior to placement of the formed conductors about a core at a closing die.
Figure 2:
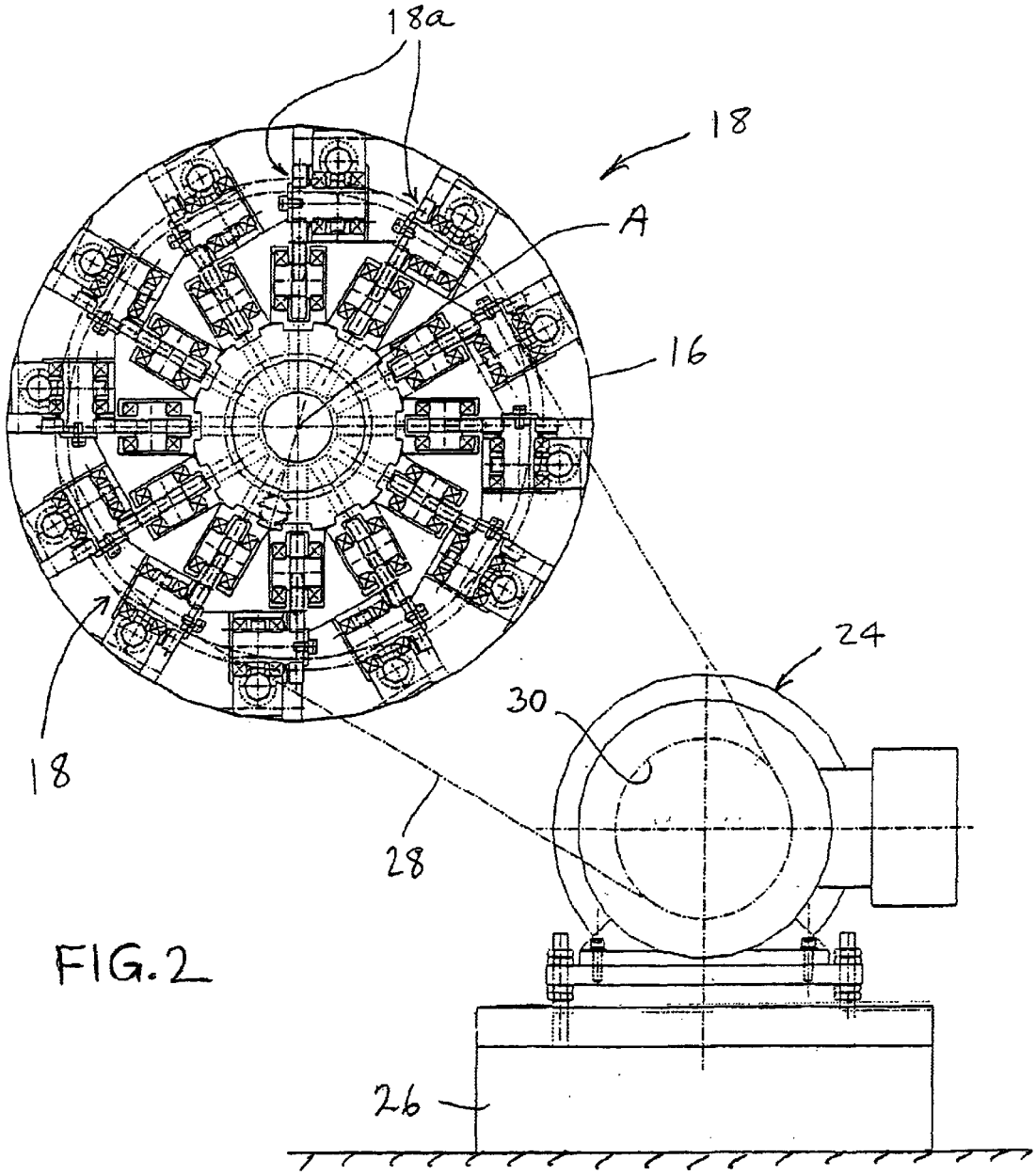
FIG. 2 is a front elevational view of the forming apparatus shown in FIG. 1.

Referring now specifically to the Figures, in which identical or similar parts are designated by the same reference numerals throughout, and first referring to FIGS. 1 and 2, an apparatus for the manufacture of compacted cables in accordance with the present invention is generally designated by the reference numeral 10.

The apparatus is used in conjunction with a cage strander arranged for rotation about a line axis A at a selected rotational speed. As indicated, a "cage-type machine" or "cage strander," for purposes of the discussion herein, shall mean a strander in which the product does not rotate relative to the ground. Thus, the material that is applied rotates around a center line and the core while the strander rotates. Examples of such machines include bow stranders, skip stranders, rigid stranders, planetary stranders and tubular stranders. Examples of such machines are disclosed, for example, in U.S. Pat. Nos. 3,902,307; 3,827,255; 4,253,298; 4,098,063; 5,074,140; and 4,212,151. The nature of the specific "rigid cage" strander or machine is not critical for the purposes of the present invention. Because such stranders are well known, they are not specifically illustrated in the drawings but simply designated by a block "S" in FIG. 1. The line axis A is generally coextensive with the machine axis of the strander S.

As viewed in FIG. 1, the product flows from the strander S downstream or from the right towards the left, as suggested by the arrow 12. As will be more fully discussed herein, a forming apparatus generally designated by the reference numeral 14 is provided and cooperates with the rigid cage strander S by processing the round of circular cross-section wires or conductors that are conveyed from the strander. However, the forming apparatus 14 can either be a stand-alone or "portable" unit that is simply positioned "in-line" with the strander S or the forming apparatus 14 may be mounted directly on and form part of the strander. As best seen in FIG. 2, the forming apparatus 14 includes a generally circular frame 16 on which there are mounted a plurality of pairs or sets of forming rollers 18. The pairs or sets of forming rollers are generally uniformly distributed or spaced from each other about the line axis A in accordance with the embodiment shown. Twelve sets or pairs of forming rollers are provided for application of twelve profiled conductors about a core. Each set or pair of forming rollers includes a radially outer roller 18*a* and a radially inner roller 18*b* aligned with an associated outer roller 18*a*. A suitable roller adjustment mechanism 20 is provided for adjusting the relative spacing between the shaping rollers of each pair or set in order to change the size or shape of the profiles formed.

The specific construction of the forming apparatus and/or the method of adjusting the rollers is not critical for purposes of the present invention, and any suitable or known forming arrangements may be used. For example, the arrangements shown in U.S. Pat. Nos. 5,074,140 and 4,212,151 can be used, and the substance of the disclosures of these aforementioned patents is fully incorporated herein.

As suggested, the forming apparatus 14 can be a stand-alone or "portable" unit that can be placed in line with a rigid frame strander S or may be attached to it by means of a suitable interface 22 (FIG. 1). Such interface may comprise any suitable mounting method for mounting the forming apparatus 14 on the strander S, a common shaft being suggested in FIG. 1. A motor 24, shown mounted on a support based 26, is mechanically coupled to the forming apparatus 14 by means of a drive-belt 28 that engages a pulley 30 mounted on the shaft of the motor. In the example illustrated in FIGS. 1 and 2, the motor 24 can be used to rotate the forming apparatus 14 at the same speed of rotation as the rotation of the strander S.

An important feature of the present invention is the provision of a drive for rotating and, therefore, driving the forming rollers. This may be achieved by driving only the outer shaping rollers 18*a*, only the inner shaping rollers 18*b*, or both. Different methods and devices for powering the rollers are well known in the art, reference being made to the aforementioned patents.

Figure 3:
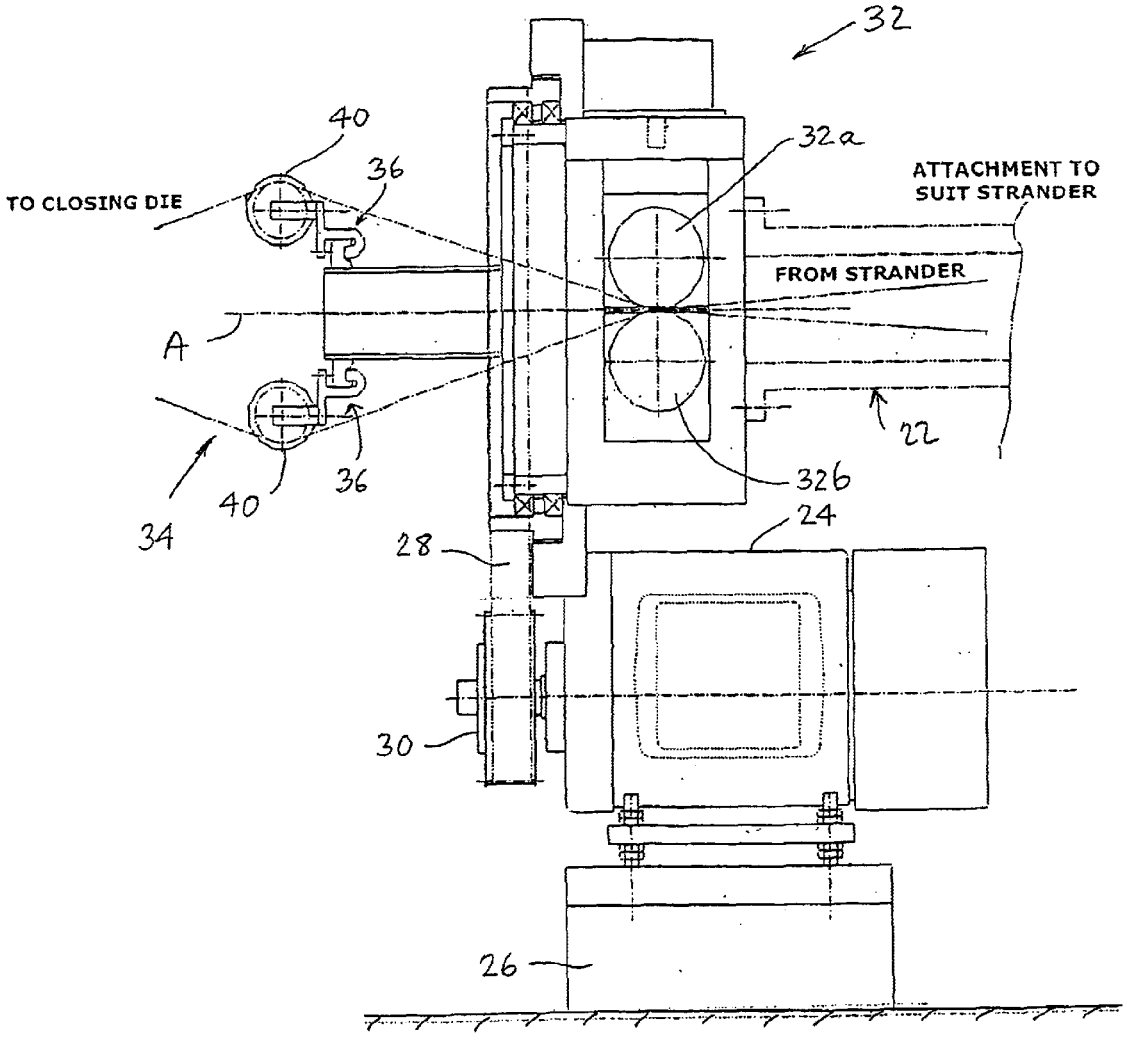
FIG. 3 is a side elevational of a second embodiment of a forming apparatus in accordance with the invention, in which a single pair of multi-grooved rollers is used in conjunction with a lay distribution plate is used in place of a plurality of substantially uniformly spaced forming rollers.
Figure 4:
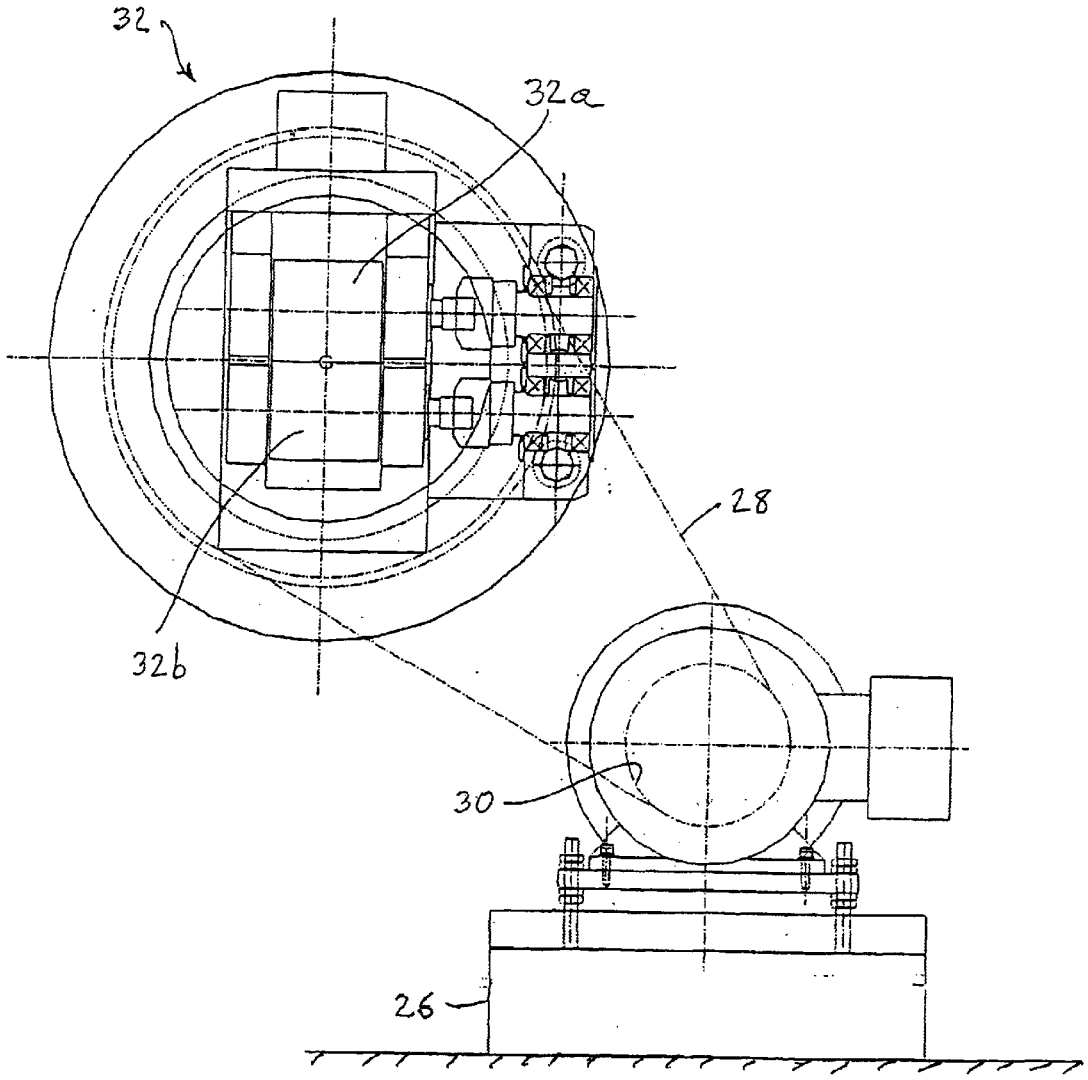
FIG. 4 is a front elevational view of the forming apparatus shown in FIG. 3.

Referring to FIGS. 3 and 4, another embodiment of a forming apparatus is generally designated by the reference numeral 32. As with the previously described forming apparatus 14, the forming apparatus 32 can also serve as a stand-alone or a portable forming device, which is suitably arranged downstream of a cage strander. When mounted on the strander, the forming apparatus 32 can be mechanically coupled by means of an interface mounting member 22 as previously described. However, the forming apparatus 32 uses one driven roll set instead a commonly driven ring of individual roll sets, as was the case in the first embodiment of FIGS. 1 and 2. With the one driven roller set 32*a*, 32*b*, which rollers are provided with multiple grooves, all the wires for a given layer are simultaneously fed to and processed by the multiple grooves between the surfaces of the two rollers. A similar roller forming arrangement utilizing one pair or set of driven rollers is disclosed, for example, in U.S. Pat. No. 4,599,853. As such roller sets are known, they are not described herein in detail. However, the description of the single roller set disclosed in U.S. Pat. No. 4,599,853 is incorporated herein.

When all of the formed conductors are initially aligned in a single plane, emanating from between the upper and lower drive rollers 32*a*, 32*b*, the formed or profiled conductors need to be positioned and oriented in relation to each other and to the core to substantially correspond to the positions and orientations therebetween in the final twisted compact conductor before the profiled conductors are directed to the closing die. For this purpose, there is shown in FIG. 3 a distributor apparatus or lay plate 34 which is suitably mounted at 36 on a common shaft 38 that rotates with the forming apparatus 32. The specific construction of the lay plate or distribution apparatus 34 is not critical, and may be of any variously known types that will perform the function of suitably orienting the profiled conductors. In the embodiment shown, a plurality of guide rollers 40 are shown illustrated to be distributed about the line axis A, each of the guide rollers or sheaves 40 suitably orienting a profiled conductor and redirecting same to a closing die in the desired position and orientation, as discussed in the aforementioned U.S. Pat. No. 4,599,853.

The specific manner of rotating the upper and lower drive rollers 32*a*, 32*b* is not critical, and any suitable arrangement may be used.

Figure 5:
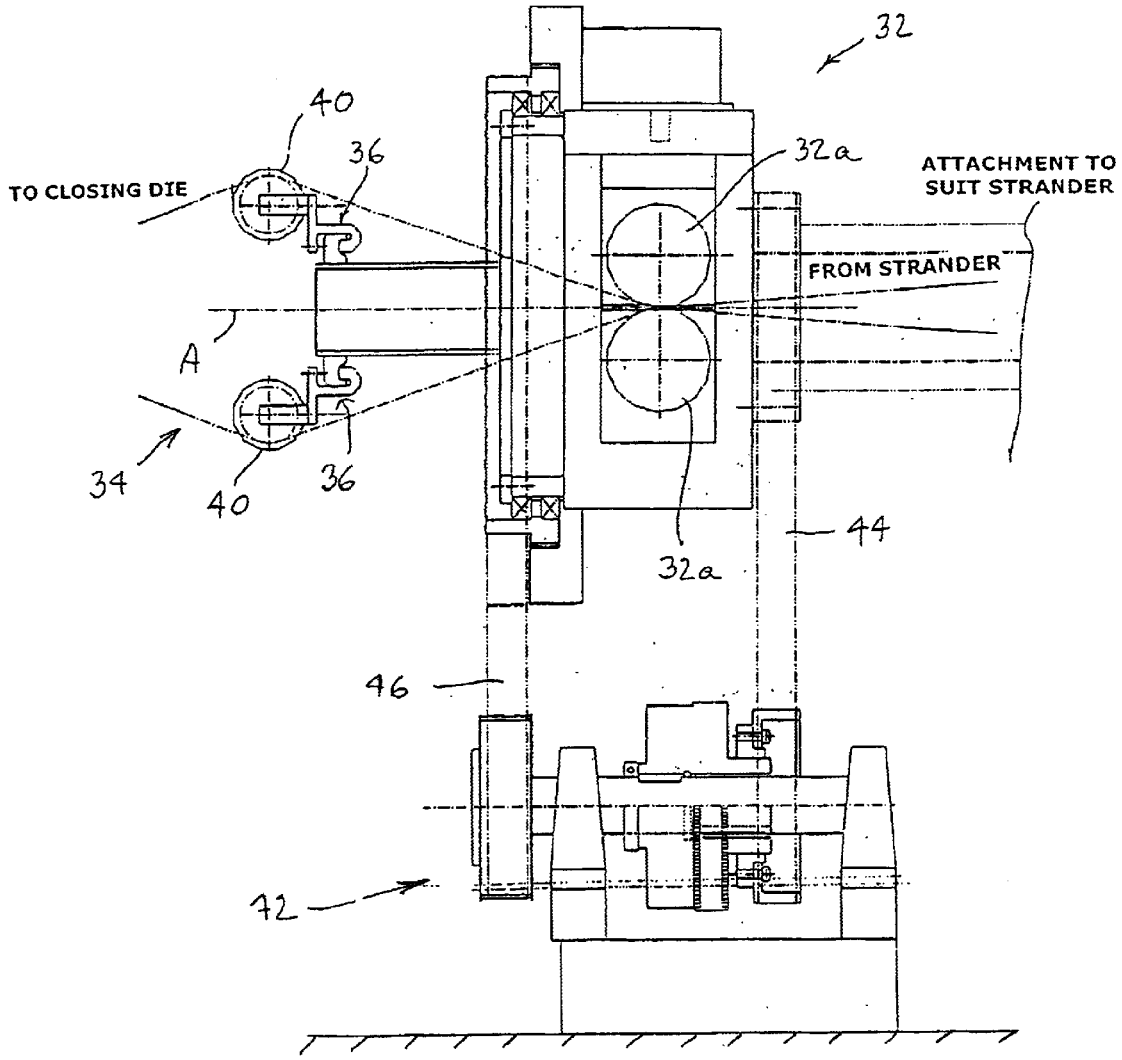
FIG. 5 is similar to FIG. 3, but shows the common forming rollers driven by a differential drive for maintaining or synchronizing the speed of the forming rollers with the rotation of the forming apparatus about the line axis.
Figure 6:
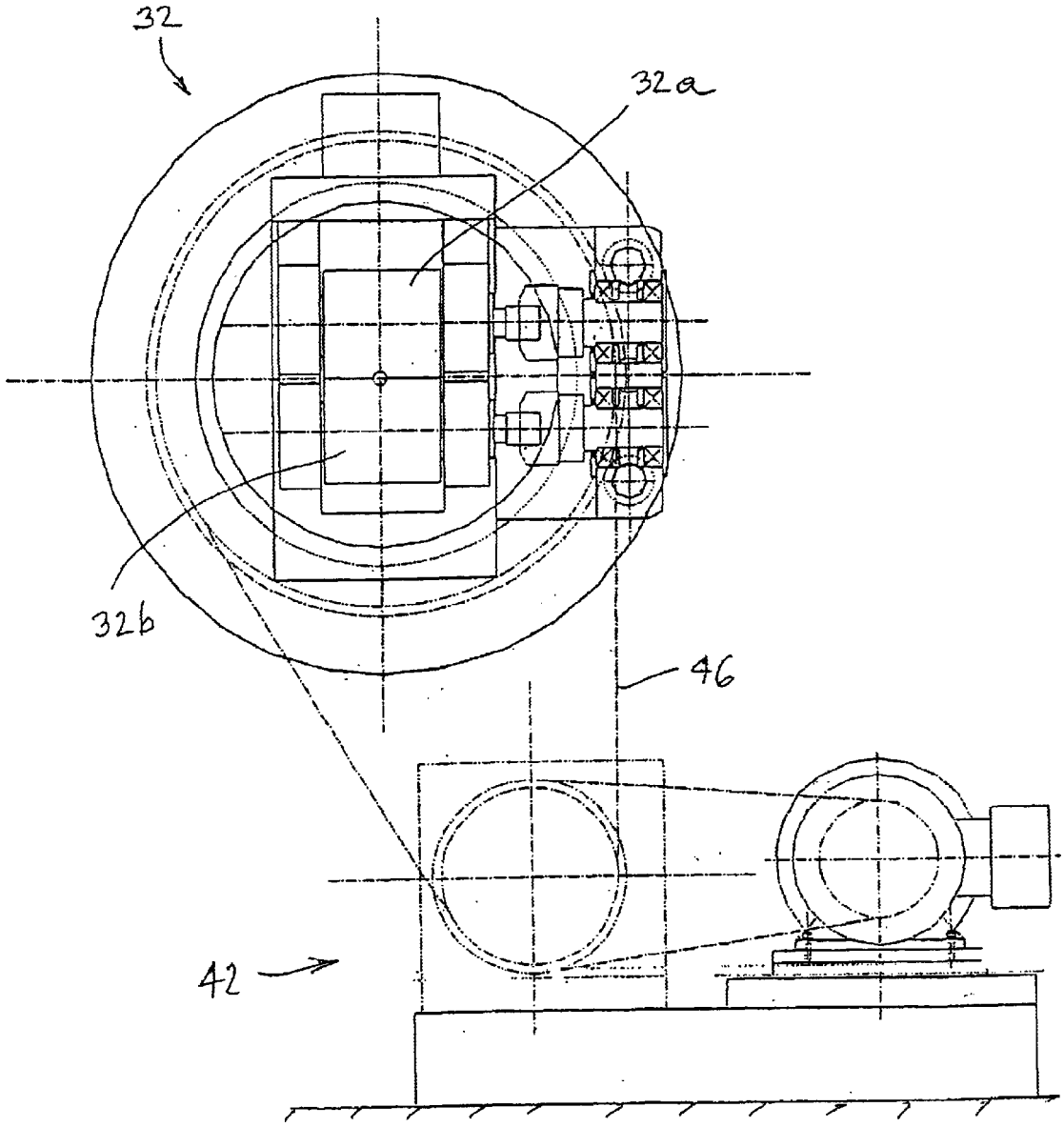
FIG. 6 is a front elevational view of the forming apparatus shown in FIG. 5.

In referring to FIGS. 5 and 6, the apparatus is identical to the one shown in FIGS. 3 and 4. However, the forming apparatus 32 is not driven by a common shaft attached to the rigid strander. Instead, a suitable differential drive 42 is utilized that includes drive belts 44 and 46 coupled to the forming apparatus. The differential drive 42 and its operation are well known for synchronizing the rotation speed of the forming apparatus 32 about the line axis A as well as the rotational speeds of the driven rollers 32*a*, 32*b* to ensure that the proper linear velocity of the formed conductors as they move downstream in the direction of the line axis A. Those skilled in the art are well familiar with differential drives of the type illustrated. Different control modes can be used to regulate the differential drive, including torque-assisted as well as speed differential devices.

In view of the foregoing, it is will be evident from the prior art strander constructions that driven roll forming devices have not up to now been used in connection with rigid stranders. However, in view of the expanding scope of products for which demand has been created, the use of a stand-alone or portable forming device used in conjunction with rigid cage stranders can make such stranders more useful and able to produce products that such rigid cage stranders have not been able to produce up to now. This is particularly true with improved differential line drives and digital circuitry that can precisely control and synchronize the rotational speeds of the forming devices, as well as the rotational speeds of the forming rollers in relation to the rotational speeds of the cage stranders.

Additional benefits of the apparatus and method disclosed in the present invention include:

(1) Strand compactness is optimized.

(2) Product quality is statistically more predictable (3) Stranding speed is not compromised (4) Rolled profiles can be introduced in a planetary mode for wire constructions with high tensile cores. For example aluminum-clad steel for transmission and OPGW applications.

(5) A significant reduction in the power required to produce the compacted layer.

(6) Significant reduction in damage on the profile compared with the traditional process of rolling on a wire drawing machine winding on a take up reel and subsequently unwinding on the strander.

(7) Greater flexibility in the geometry that can be used for each layer that enhances SIW or Single Input Wire strand programs.

While this invention has been described in detail with particular reference to preferred embodiments thereof, it will be understood that variations and modifications will be effected within the spirit and scope of the invention as described herein and as defined in the appended claims.

What is claimed is:

1. An apparatus for the manufacture of cable formed by at least one uniform lay of conductors received about and compacted on a core comprising:

(a) a cage strander arranged for rotation about a line axis at a selected rotational speed;

(b) a plurality of bobbins at least equal in number to the number of conductors in said lay each supporting a length of round conductor, each of said bobbins being supported by said cage strander and arranged for dispensing a round conductor downstream of said cage strander;

(c) a forming apparatus arranged downstream of said cage strander for receiving said conductors and forming them into a plurality of complementary segmented pre-shaped wires each having a desired cross-sectional profiled configuration in a final compact conductor and each defining at least lateral surfaces;

(d) means for positioning and orienting the pre-shaped wires in relation to each other to substantially correspond to the positions and orientations therebetween in the final twisted compact conductor;

(e) first driving means for rotating said forming apparatus about said line axis substantially at the speed of the rotation of said cage strander; and (f) second driving means for driving said forming apparatus, said first and second driving means being synchronized to allow said formed conductors to be closed about said core to cause the lateral surfaces of adjacent pre-shaped wires to substantially abut against each other and to produce the desired lay, whereby interstices between the conductors forming the twisted conductor are substantially eliminated to form a compact twisted conductor, wherein said forming apparatus is supported by said strander means, said forming apparatus including a plurality of former means, continuously receiving a single conductor, said former means including:

(a) a first roller having a cylindrical surface;

(b) a second roller having a surface including a plurality of grooves of a non-round cross-section thereal-ong for accommodating round conductors of different gage and for forming said conductor to a non-round configuration; and (c) mounting means for supporting said rollers for rotation about parallel axes, each said roller being disposed in position whereby said conductor is deformed substantially to the cross-section of said groove through rolling action of said first roller.

2. An apparatus for the manufacture of cable as defined in claim 1, wherein said means for positioning and orienting includes a closing die downstream of said forming apparatus for closing the formed conductors simultaneously on said core.

3. An apparatus for the manufacture of cable formed by at least one uniform lay of conductors received about and compacted on a core comprising:

(a) a cage strander arranged for rotation about a line axis at a selected rotational speed;

(b) a plurality of bobbins at least equal in number to the number of conductors in said lay each supporting a length of round conductor, each of said bobbins being supported by said cage strander and arranged for dispensing a round conductor downstream of said cage strander;

(c) a forming apparatus arranged downstream of said cage strander for receiving said conductors and forming them into a plurality of complementary segmented pre-shaped wires each having a desired cross-sectional profiled configuration in a final compact conductor and each defining at least lateral surfaces;

(d) means for positioning and orienting the pre-shaped wires in relation to each other to substantially correspond to the positions and orientations therebetween in the final twisted compact conductor;

(e) first driving means for rotating said forming apparatus about said line axis substantially at the speed of the rotation of said cage strander; and (f) second driving means for driving said forming apparatus, said first and second driving means being synchronized to allow said formed conductors to be closed about said core to cause the lateral surfaces of adjacent pre-shaped wires to substantially abut against each other and to produce the desired lay, whereby interstices between the conductors forming the twisted conductor are substantially eliminated to form a compact twisted conductor, wherein said second driving means comprises a drive motor and linking means for translating the rotary motion of said drive motor to rotary motion of said forming apparatus to impart a linear motion on the conductors while they are being formed.

4. An apparatus for the manufacture of cable as defined in claim 3, wherein said forming apparatus is mounted on said cage strander and said first driving means comprises a mechanical interface for mechanically connecting said cage strander and forming an apparatus for common rotation about said line axis.

5. An apparatus for the manufacture of cable as defined in claim 3, wherein said forming apparatus is a stand-alone unit downstream and substantially in-line with said cage strander, and said first driving means comprises a drive for rotating said forming apparatus about said line axis at a rotational speed that substantially corresponds to the rotational speed of said cage strander.

6. An apparatus for the manufacture of cable as defined in claim 5, wherein said drive comprises an electromechanical motor.

7. An apparatus for the manufacture of cable as defined in claim 3, wherein said forming apparatus comprises at least one pair of shaping rollers.

8. An apparatus for the manufacture of cable as defined in claim 7, wherein a plurality of pairs of shaping rollers are provided and arranged about said line axis and substantially equally spaced from each other.

9. An apparatus for the manufacture of cable as defined in claim 8, further comprising adjustment means for adjusting the relative positions of the shaping rollers of each pair to each other to control the shape and degree of forming of the conductors.

10. An apparatus for the manufacture of cable formed by at least one uniform lay of conductors received about and compacted on a core comprising:

(a) a cage strander arranged for rotation about a line axis at a selected rotational speed;

(b) a plurality of bobbins at least equal in number to the number of conductors in said lay each supporting a length of round conductor, each of said bobbins being supported by said cage strander and arranged for dispensing a round conductor downstream of said cage strander;

(c) a forming apparatus arranged downstream of said cage strander for receiving said conductors and forming them into a plurality of complementary segmented pre-shaped wires each having a desired cross-sectional profiled configuration in a final compact conductor and each defining at least lateral surfaces;

(d) means for positioning and orienting the pre-shaped wires in relation to each other to substantially correspond to the positions and orientations therebetween in the final twisted compact conductor;

(e) first driving means for rotating said forming apparatus about said line axis substantially at the speed of the rotation of said cage strander; and (f) second driving means for driving said forming apparatus, said first and second driving means being synchronized to allow said formed conductors to be closed about said core to cause the lateral surfaces of adjacent pre-shaped wires to substantially abut against each other and to produce the desired lay, whereby interstices between the conductors forming the twisted conductor are substantially eliminated to form a compact twisted conductor, wherein said cage strander rotates by the action of said first drive means and said second driving means comprises a differential drive.

11. An apparatus for the manufacture of cable formed by at least one uniform lay of conductors received about and compacted on a core comprising:

(a) a cage strander arranged for rotation about a fine axis at a selected rotational speed;

(b) a plurality of bobbins at least equal in number to the number of conductors in said lay each supporting a length of round conductor, each of said bobbins being supported by said cage strander and arranged for dispensing a round conductor downstream of said cage strander;

(c) a forming apparatus arranged downstream of said cage strander for receiving said conductors and forming them into a plurality of complementary segmented pre-shaped wires each having a desired cross-sectional profiled configuration in a final compact conductor and each defining at least lateral surfaces;

(d) means for positioning and orienting the pre-shaped wires in relation to each other to substantially correspond to the positions and orientations therebetween in the final twisted compact conductor;

(e) first driving means for rotating said forming apparatus about said line axis substantially at the speed of the rotation of said cage strander; and (f) second driving means for driving said forming apparatus, said first and second driving means being synchronized to allow said formed conductors to be closed about said core to cause the lateral surfaces of adjacent pre-shaped wires to substantially abut against each other and to produce the desired lay, whereby interstices between the conductors forming the twisted conductor are substantially eliminated to form a compact twisted conductor, wherein said forming apparatus comprises two multi-grooved forming rollers mounted for rotation about substantially parallel axes, each groove being arranged to receive another conductor and shaped to impart a desired cross-sectional compacted profile.

12. An apparatus for the manufacture of cable as defined in claim 11, further comprising a lay distribution plate downstream of said two multi-grooved forming rollers for orienting the formed conductors to application on said core.

13. An apparatus for the manufacture of cable as defined in claim 12, wherein said lay distribution plate is mounted for rotation with said cage strander and with said forming apparatus about said line axis.

14. An apparatus for the manufacture of cable as defined in claim 13, wherein said lay distribution plate is mounted on a common shaft with said forming apparatus.

15. An apparatus for the manufacture of cable as defined in claim 13, wherein said lay distribution plate includes a plurality of guide rollers equal to the number of conductors formed by said forming apparatus and uniformly distributed about said line axis for receiving a formed conductor and suitably orienting the formed conductor prior to application about said core at a closing station.

* * * * *